US006161322A

United States Patent [19]

Liebenberg

[11] Patent Number: 6,161,322

[45] Date of Patent: Dec. 19, 2000

[54] FIREARM HAVING CHAMBER STATUS INDICATOR AND FIREARM RETROFITTING METHOD

[75] Inventor: Paul Liebenberg, Agawam, Mass.

[73] Assignee: Smith & Wesson Corp., Springfield, Mass.

[21] Appl. No.: 09/079,676

[22] Filed: May 15, 1998

[51] Int. Cl.[7] ..... F41G 1/54

[52] U.S. Cl. ..... 42/1.05

[58] Field of Search ..... 42/1.05, 1.01

[56] References Cited

U.S. PATENT DOCUMENTS

| | | | |
|---|---|---|---|
| 945,328 | 1/1910 | Johnson . | |
| 1,028,032 | 5/1912 | Krag . | |
| 2,416,712 | 4/1947 | Parker | 42/76 |
| 3,401,665 | 9/1968 | Kelley | 42/1.05 |
| 3,901,125 | 8/1975 | Raville | 89/163 |
| 4,089,250 | 5/1978 | Jakubowski, Jr. et al. | 89/1.57 |
| 4,216,601 | 8/1980 | Musgrave | 42/1 B |

FOREIGN PATENT DOCUMENTS

| | | |
|---|---|---|
| 395.045 | 9/1908 | France . |
| 334041 | 8/1919 | Germany . |

*Primary Examiner*—Stephen M. Johnson
*Attorney, Agent, or Firm*—McCormick, Paulding & Huber LLP

[57] ABSTRACT

Semi-automatic breech locking pistol having a reciprocally movable slice defining an upwardly and laterally outwardly open ejection port and a barrel including a rear part having a rearwardly extending headspace extension hood and exposed within and providing a closure for the ejection port in locked breech condition. A rearwardly open notch formed in the headspace extension hood facilitates determination of chamber status by direct visual observation.

15 Claims, 2 Drawing Sheets

FIREARM HAVING CHAMBER STATUS INDICATOR AND FIREARM RETROFITTING METHOD

FIELD OF INVENTION

This invention relates in general to firearms and deals more particularly with an improved chamber status indicator for a semi-automatic or auto-loading handgun, which has a barrel including a headspace extension hood, and a method for retrofitting such a handgun with a chamber status indicator.

BACKGROUND OF THE INVENTION

The present invention is particularly concerned with improvements in semi-automatic or auto-loading pistols of the type having reciprocal breech closures.

Such pistols, of conventional construction, fire in response to trigger pressure and automatically re-load and return to closed breech position ready to fire again. The user of such an auto-loading pistol cannot determine with certainty whether there is a round in the barrel chamber after the pistol has been fired, because the breech is in its closed position.

Heretofore various mechanical devices have been provided on such auto-loading pistols to indicate the presence of a round in the chamber. Such mechanical devices typically employ intricate mechanisms and often include some form of mechanical sensor for engaging a portion of a chambered cartridge and altering the position of an associated externally exposed indicator, thereby signaling the presence of a cartridge in the barrel chamber. However, the provision of such a mechanical device on a firearm usually add substantially to the cost of producing the gun. Further, if a mechanical chamber status indicating device becomes damaged it may falsely indicate a safe or unloaded chamber condition, which could lead to a disastrous result. Those devices which provide chamber status indication by the change of position of an indicator may require the gun user to rapidly recall the indicator position associated with a particular chamber condition, which introduces the possibility of human error.

A further approach to the problem has been to provide a sighting opening in the barrel which opens into the bore immediately forward of the cartridge chamber or into the cartridge chamber to allow direct viewing of a portion of a chambered cartridge. However, as far as can be determined, previous efforts to provide a satisfactory observation port in the barrel of a firearm have been unsuccessful. Another somewhat similar approach has been to provide a peep-notch at least partially defined by the bolt and opening through the bolt face to permit direct observation of a portion of the rim or base of a chambered cartridge. However, of the aforesaid approaches are invasive to critical parts of the firearm and tend to compromise the structural integrity of either or both the barrel and the bolt, which may cause cartridge jamming or improper cartridge extraction.

Accordingly, it is the general aim of the present invention to provide, in a semi-automatic or auto-loading handgun having a reciprocally movable breech closure and which includes an improved chamber status indicator which allows direct visual inspection of a portion of the breech when the breech closure is in its closed position. A further aim of the present invention is to provide a breech observation aperture in a firearm of the aforedescribed type without compromising the structural integrity of the firearm or significantly increasing the cost of producing it. Yet another aim of the invention is to provide a method for retrofitting a firearm of the aforedescribed general type to provide the firearm with a breech observation aperture without jeopardizing the structural integrity of the firearm.

SUMMARY OF THE INVENTION

In accordance with the present invention, an improved auto-loading pistol has a frame and a slide which includes an upwardly and laterally outwardly open ejection port. The slide is supported on the frame for forward and rearward reciprocal movement between firing and retracted positions respectively corresponding to closed and open breech conditions. The pistol further includes a barrel having a rearwardly facing breechface, a bore defined by and extending through the barrel, a chamber at the rear of the bore and opening through the breechface, and a headspace extension hood projecting rearwardly from the breechface above the chamber. In accordance with the invention, a chamber status indicating means is provided for enabling a user of the gun to determine whether a round of ammunition is chambered within the gun and comprises an aperture in the headspace extension hood. The aperture is exposed within the ejection port when the slide is in firing position relative to the barrel and permits a user of the pistol to determine chamber status by direct observation.

DETAILED DESCRIPTION OF PREFERRED EMBODIMENT AND METHOD

Figure 1:
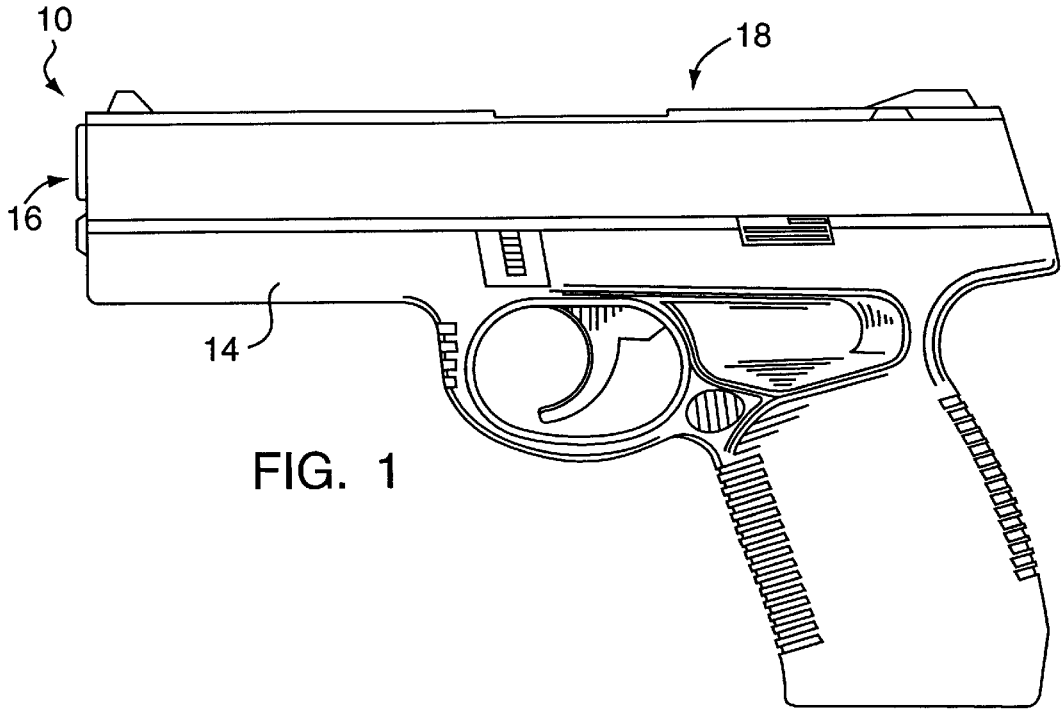
FIG. 1 is a left side elevational view of a semi-automatic or auto-loading pistol embodying the present invention.

Although the chamber status indicator of the present invention may be utilized in virtually any firearm having a barrel including an externally exposed headspace extension hood, it is particularly suitable for use in a semi-automatic or auto-loading handgun of a type which has a reciprocally movable breech closure or slide and employs either a locking breech or blowback system of operation.

In the drawing and in the description which follows, the invention is illustrated and described with reference to a semi-automatic handgun or pistol of the locked breech type. In a pistol of the latter type the breech closure or bolt, which usually comprises an integral part of the slide, is securely locked to the barrel and remains in a locked condition until the bullet has left the barrel and the pressure at the breech, generated by the gasses of explosion, has dropped to a level at which it is safe to open the breech and commence cartridge extraction, all of which is well known in the firearm art.

The chamber status indicator of the present invention is illustrated and hereinafter further described with reference to a SMITH & WESSON SIGMA SERIES Model SW40V semi-automatic pistol, shown in FIG. 1 and indicated generally by the reference numeral 10, modified to include a chamber status indicator designated generally by the reference numeral 12. The illustrated pistol 10 is manufactured and marketed by Smith & Wesson, Springfield, Massachusetts 01102, assignee of the present invention.

Figure 2:
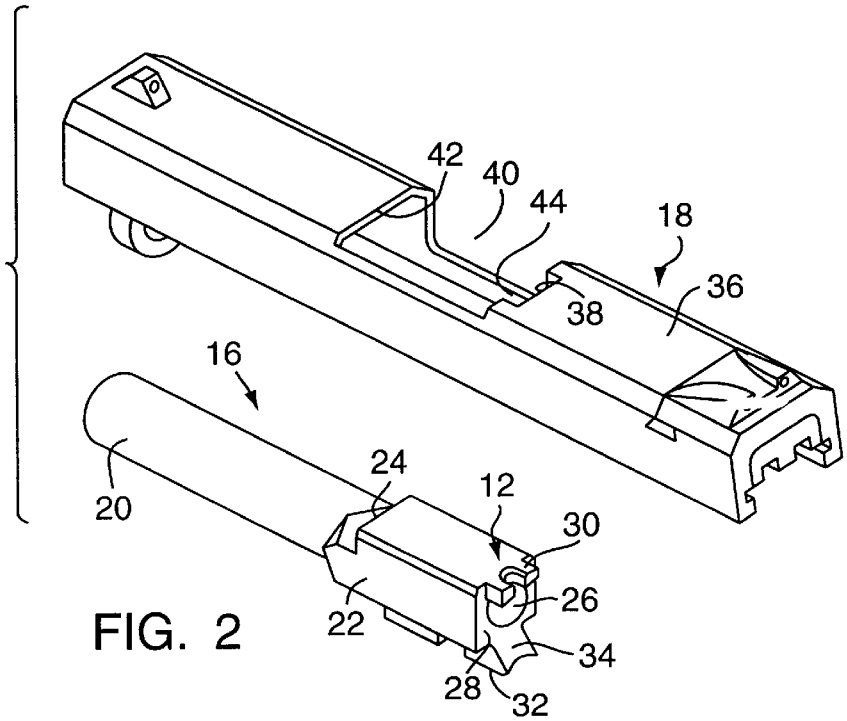
FIG. 2 is a an exploded perspective view showing the slide and the barrel of the pistol of FIG. 1.
Figure 3:
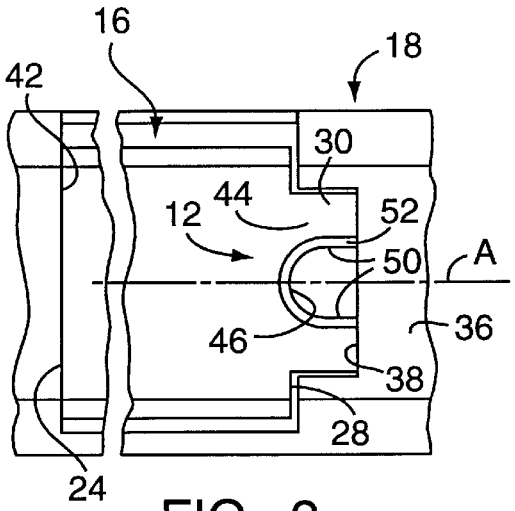
FIG. 3 is a somewhat enlarged fragmentary top plan view showing the barrel and slide in closed breech position.
Figure 4:
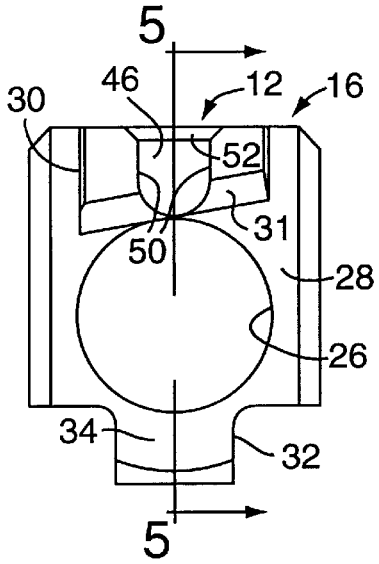
FIG. 4 is a somewhat enlarged rear elevational view of the barrel.
Figure 5:
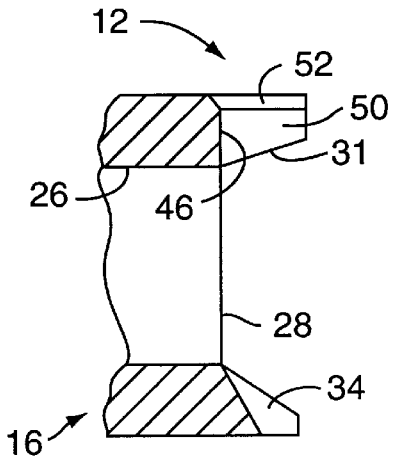
FIG. 5 is a fragmentary sectional view through the barrel taken along the line 5—5 of FIG. 4.
Figure 6:
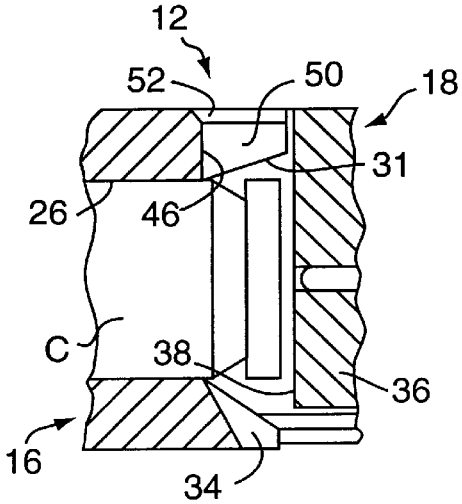
FIG. 6 is a fragmentary axial sectional view through the barrel and the slide and shows the breech in closed position and a round of ammunition in the chamber.

In the drawing and in the further description which follows, only those components of the firearm 10 essential to an understanding of the chamber status indicator 12 are illustrated and described in detail. Further referring to the drawing, the illustrated pistol 10 has a frame 14, a barrel loosely attached to the frame and indicated generally by the reference numeral 16 and a partially hollow slide designated generally by the numeral 18 within which at least a portion of the barrel 16 is contained. The slide is supported on the frame 14 by conventional ways for rearward and forward reciprocal sliding movement relative to the frame between firing and retracted positions corresponding, respectively, to closed and open breech positions. In FIG. 1 the pistol 10 is shown in its closed breech or firing position. The axially elongated barrel 16, best shown in FIG. 2, defines a conventional axially extending pistol bore and has a generally cylindrical forward end portion 20 and a somewhat radially enlarged rear portion 22 of generally rectangular cross-section. The rear portion has a forwardly facing upper edge 24 and defines a chamber 26 at the rear end of the bore which opens through a rearwardly facing breechface 28. A headspace extension hood 30, which comprises an integral part of the barrel 16, projects rearwardly from the breechface 28 immediately above the chamber 26 as best shown in FIGS. 2–4. The headspace extension hood has a generally rectangular configuration, as viewed from above, and as best shown in FIG. 3 and has an upwardly and laterally inclined lower surface 31 as shown in FIG. 4. The lower surface 31 is also rearwardly and upwardly inclined from the breechface as shown in FIGS. 5 and 6. A conventional barrel cam 32 integrally depends from the rear part 22 and defines a downwardly and rearwardly inclined and rearwardly facing ramp surface 34 which cooperates with a cartridge magazine (not shown) to guide a cartridge into the chamber 26 in response to return movement of the slide 18 to its closed breech position after the pistol 10 has been fired, all of which is conventional and well-known in the pistol art.

The pistol slide 18 has a hollow downwardly open forward portion for receiving at least a part of the barrel 16. The rear end portion of the slide defines an integral bolt 36 having a forwardly facing bolt face 38, shown in FIG. 6. An ejection port 40 opens upwardly and laterally outwardly through the right side of the slide, as shown in FIG. 2. The forward end of the ejection port 40 is defined by a rearwardly facing edge surface 42. The ejection port 40 has a forwardly open notch 44 for receiving and complementing the headspace extension hood 30 when the pistol 10 is in its closed breech or firing position, as it appears in FIG. 3. The forwardly facing rear surface of the notch 44 lies within the plane of the bolt face 38 and is defined by an upward extension of the bolt face 38.

When the pistol 10 is in its closed breech position, as it appears in FIGS. 1, 3 and 6, the headspace extension hood 30 is disposed within the notch 44 and the forwardly facing surface 24 on the barrel is engaged with the rearwardly facing surface 42 on the slide thereby locking the barrel to the slide. The pistol 10 normally returns to the latter breech locked position after each round has been fired.

In accordance with the present invention, the chamber status indicator essentially comprises the aperture or notch 12 which is formed in the headspace extension hood 30. Preferably, and as shown, the notch 12 extends in a direction generally parallel to the axis of the bore and opens through the rear of the headspace extension hood 30. In FIG. 3 the bore axis is indicated by the letter A. The notch 12 has a crescent shaped inner end portion 46 which, as shown, is preferably semi-cylindrical and generally tangent to the plane of the breechface 28. The rear portion of the notch is preferably formed by a pair of opposing sidewall surfaces 50, 50 which extend rearwardly in parallel relation to each other and to the axis A from opposite ends of the semi-circular inner end portion 46. A chamfer 52 is preferably formed at the upper end of the notch 12, substantially as shown.

The chamber status indicator hereinbefore described allows the user of a pistol to see a portion of the rim of a cartridge, such as the cartridge C shown in FIG. 6, when the cartridge is chambered in the pistol and viewed from above and through the notch 12. When the pistol is loaded the rim of the chambered cartridge case, which has a brass or sliver color, can be seen when viewed through the notch 12. In contrast, the empty chamber 26 appears dark when the firearm is not loaded.

The dimensions and precise configuration of the notch 12 may vary and depend upon the size of the headspace extension hood. The dimensions of the aperture 12 are not critical, but an aperture or slot adequate to allow for visual observation of the rim of a chambered cartridge is necessary. The production cost added by the provision of the present chamber status indicator is minimal, because the provision of the indicator does not add parts to the firearm. The headspace extension hood does not function to support a chambered cartridge therefore no loss of barrel strength or integrity results from modification of the headspace extension hood.

Further, and in accordance with the present invention, a firearm of the general type hereinbefore described and having a headspace extension hood, which is externally exposed in the closed breech position of the firearm, may be retrofitted With a chamber status indicator such as hereinbefore described. The retrofitting method includes the steps of removing the barrel from the firearm to be retrofitted and forming an aperture or notch 12 in the headspace extension hood generally as hereinbefore discussed. A notch is preferably formed in and centrally of the rear edge of the headspace hood extension by a milling operation. The notch forming operation is terminated when the forwardmost end of the notch is disposed in alignment with the plane of the breechface. The lateral width of the milled notch or slot is preferably approximately equal to 35 percent of the lateral width of the headspace extension hood. If the headspace hood extension on the firearm to be retrofitted is sufficiently large the aperture 12 may comprise a cylindrical hole formed by drilling through hood extension tangent to the breechface. The retrofitting operation is completed by forming a chamfer at the upper or exposed end of the aperture 12.

I claim:

1. A self-loading pistol comprising a frame, a slide having an upwardly and laterally outwardly open ejection port and supported on said frame for forward and rearward reciprocal movement between firing and retracted positions relative to said frame, an axially elongated barrel supported on said frame and at least partial disposed within said slide, said barrel having a rearwardly facing breechface, a bore extending axially therethrough, a chamber at the rear of said bore and opening through said breechface, and a headspace extension hood rearwardly projecting from said breechface above said chamber, and chamber status indicating means for enabling determination as to whether a round of ammunition is chambered within said pistol and including a notch extending through said headspace hood extension in a direction generally parallel to the axis of said bore, said notch opening through the rear of said headspace extension hood and terminating at a forward end at said breechface, said notch being exposed within said ejection port when said slide is in said firing position to provide indication of chamber status by direct visual observation.

2. The self-loading pistol as set forth in claim 1 wherein said notch has a crescent shaped inner end portion.

3. The self-loading pistol as set forth in claim 2 wherein said crescent shaped inner end portion is generally semi-cylindrical.

4. The self-loading pistol as set forth in claim 3 wherein said semi-cylindrical inner end portion is generally tangent to a plane defining said breechface.

5. The self-loading pistol as set forth in claim 4 wherein said notch has a rear portion defined by opposing rearwardly extending parallel surfaces.

6. The self-loading pistol as set forth in claim 1 wherein said notch opens upwardly through said headspace extension hood and said notch has a chamfer at its upper end.

7. The self-loading pistol as set forth in claim 1 wherein said headspace extension hood has an upwardly inclined and laterally outwardly extending lower surface.

8. The self-loading pistol as set forth in claim 7 wherein said lower surface is upwardly and rearwardly inclined from said breechface.

9. The self-loading pistol as set forth in claim 1 wherein the lateral width of said notch is approximately 35 percent of the lateral width of said headspace extension hood.

10. A semi-automatic pistol comprising a frame, a slide supported on said frame for rearward and forward reciprocal sliding movement between firing and retracted positions and having a forward part defining a downwardly open recess and a rear port including a bolt having a forwardly facing bolt face, said slide having an upwardly and laterally outwardly open ejection port opening into said recess and partially defined by an upward extension of said bolt face, an axially elongated barrel loosely supported by said frame and at least partially disposed within said recess, said barrel having a generally rearwardly facing breechface and an axially extending bore including a chamber opening axial through said breechface, said barrel having an integral headspace extension hood rearwardly projecting from said breechface immediately above said chamber, and chamber status indicating means for determining whether a round of ammunition is chambered in said pistol and including a rearwardly open notch formed centrally within said headspace extension hood and extending in a direction parallel to the direction of extent of the bore axis, said notch opening upwardly through said headspace extension hood and having a semi-circular forward end portion generally tangent to the plane of said breechface and opposing laterally spaced apart side walls, extending rearwardly in parallel relation to each other, said notch having a chamfered upper end.

11. The semi-automatic pistol as set forth in claim 10 wherein said headspace extension hood has an upwardly and laterally outwardly inclined lower surface inclined upwardly and rearwardly away from said breechface.

12. A method for providing a chamber status indicator on a self-loading pistol having a frame, a slide defining an upwardly and laterally outwardly open ejection port and supported on the frame for forward and rearward reciprocal movement between firing and retracted positions relative to the frame, and a barrel mounted on the frame and at least partially disposed within the slide, the barrel having a breechface disposed within a rearwardly facing plane, a bore extending therethrough, a chamber at the rear of the bore and opening through the breechface, and an integral headspace extension hood rearwardly projecting from the breechface above the chamber, said method comprising the steps of removing said barrel from the pistol, and forming an aperture opening through the headspace extension hood rearward of the chamber and immediately adjacent the rearwardly facing plane of the breechface.

13. The method as set forth in claim 12, wherein the step of forming an aperture in further characterized as milling a notch in the headspace extension hood opening through the headspace extension hood and extending in a direction parallel to the central axis of the bore and said method includes the additional step of terminating the milling operation when the forward end of the notch is disposed within the rearwardly facing plane of the breechface rearward of the chamber.

14. The method as set forth in claim 12 wherein the step of forming an aperture is further characterized as drilling a cylindrical hole through the headspace extension hood in tangential relation to the breechface.

15. A semi-automatic pistol comprising a frame, a slide supported on said frame for forward and rearward reciprocal sliding movement between firing and retracted positions and having a forward part defining a downwardly open recess and a rear part including a bolt having a forwardly facing bolt face, said slide having an upwardly and laterally outwardly open ejection port opening into said recess and partially defined by an upward extension of said bolt face, an axially elongated barrel loosely supported by said frame for movement relative to said frame and at least partially disposed within said recess, said barrel having a generally rearwardly facing breechface and an axially extending generally cylindrical bore including a chamber opening axial through said breechface, said barrel having an integral headspace extension hood rearwardly projecting from said breechface immediately above and rearwardly of said chamber, said headspace extension hood having an upwardly and laterally outwardly inclined lower surface inclined upwardly and rearwardly away from said breechface, and chamber status indicating means for determining whether a round of ammunition is chambered in said pistol and including a rearwardly open notch formed centrally within said headspace extension hood and extending in a direction parallel to the direction of extent of the bore axis, said notch opening upwardly through said headspace extension hood and having a semi-circular forward end portion generally tangent to said breechface, said notch having opposing laterally spaced apart side walls extending rearwardly in parallel relation to each other from opposite ends of said semicircular forward end portion, said notch having a chamfered edge at its upper end.

* * * * *

UNITED STATES PATENT AND TRADEMARK OFFICE

CERTIFICATE OF CORRECTION

PATENT NO. : 6,161,322

DATED : December 19, 2000

INVENTOR(S) : Paul Liebenberg

It is certified that error appears in the above-identified patent and that said Letters Patent is hereby corrected as shown below:

Column 4, line 38, please change "With" to – with –.

Signed and Sealed this

First Day of May, 2001

*Attest:*

Nicholas P. Godici

NICHOLAS P. GODICI

*Attesting Officer*

*Acting Director of the United States Patent and Trademark Office*